US012546547B1

(12) United States Patent
Berry et al.

(10) Patent No.: US 12,546,547 B1
(45) Date of Patent: Feb. 10, 2026

(54) FIREARM PLATFORM AND METHOD OF CONNECTING UPPER AND LOWER RECEIVERS

(71) Applicants: Keith Berry, Hampden, MA (US); David Moore, Hampden, MA (US)

(72) Inventors: Keith Berry, Hampden, MA (US); David Moore, Hampden, MA (US)

( * ) Notice: Subject to any disclaimer, the term of this patent is extended or adjusted under 35 U.S.C. 154(b) by 0 days.

(21) Appl. No.: 18/413,883

(22) Filed: Jan. 16, 2024

Related U.S. Application Data

(63) Continuation-in-part of application No. 18/155,364, filed on Jan. 17, 2023, now Pat. No. 12,339,084.

(60) Provisional application No. 63/301,181, filed on Jan. 20, 2022.

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 89/125, 132, 128
See application file for complete search history.

(56) References Cited

U.S. PATENT DOCUMENTS

| | | | | |
|---|---|---|---|---|
| 8,549,982 | B2 * | 10/2013 | Troy, Jr. | F41A 19/33 89/132 |
| 9,188,399 | B1 * | 11/2015 | Findlay | F41A 3/66 |
| 10,663,239 | B2 * | 5/2020 | Timmons | F41A 3/66 |
| 10,690,428 | B1 * | 6/2020 | Vestbom | F41A 17/04 |

* cited by examiner

*Primary Examiner* — Reginald S Tillman, Jr.
(74) *Attorney, Agent, or Firm* — Wood Herron & Evans LLP

(57) ABSTRACT

A firearm platform and method of connecting an upper receiver to a lower receiver. The upper receiver has a pivot lug and a takedown lug with perimeter openings in opposite directions. The lower receiver has a locking member that pushes against the takedown lug which causes the upper receiver to displace forward. As a result of the forward displacement, a pivot pin in the lower receiver exerts an opposing force against the pivot lug. The locking member is displaced between a locked and unlocked position through a lever located on an exterior surface of the lower receiver. When the locking member is in the locked position, the lower receiver and uppers receiver form a connection that is tight and free from slop.

23 Claims, 10 Drawing Sheets

FIREARM PLATFORM AND METHOD OF CONNECTING UPPER AND LOWER RECEIVERS

CROSS-REFERENCES TO RELATED APPLICATIONS

This application is a continuation in part (CIP) of U.S. patent application Ser. No. 18/155,364 filed Jan. 17, 2023, which is a non-provisional application claiming the benefit of priority from U.S. Provisional Application No. 63/301,181 filed Jan. 20, 2022. The foregoing prior filed applications are hereby incorporated herein, in their entirety, by reference.

BACKGROUND

1. Field of the Invention

The present invention relates to the connection of an upper receiver and a lower receiver in a firearm. More specifically, the invention contemplates an upper receiver that is removeable from a lower receiver through a novel structure and method that eliminates a takedown pin and eliminates an axially displaceable pivot pin.

2. Description of the Related Art

In 1960, U.S. Pat. No. 2,951,424 issued for a Gas Operated Bolt and Carrier System employed in a firearm. The '424 Patent discloses a system that captures part of the explosive gas that drives a projectile when a firearm cartridge is detonated and diverts the captured gas to drive a bolt and a bolt carrier rearward, thereby initiating a sequence that allows for spent shell casing to be ejected and an unfired cartridge to be chambered.

The gas system disclosed in the '424 Patent was the basis for AR-15 and M16 firearms. Historically, the military developed the M16 and later variants of the M16 (e.g., the M4/M4A1 carbine, the Heckler & Koch HK416, etc.), from the AR-15. Thus, the M16 and its variants (hereinafter collectively referred to as "M16") are technically a subset or type of AR-15 firearm. However, firearm enthusiasts commonly distinguish the AR-15 and the M16 by the shooting action and availability of the firearms. In this regard, AR-15s have become known as firearms that employ a semi-automatic action and are generally available to the public, while M16s are known as fully automatic weapons used by law enforcement and the military which are not generally available to the public.

Over time, the AR-15 platform has evolved into one of the most popular weapons platforms available. One reason contributing to its popularity is the modular design of the platform and the ability to purchase readily available, interchangeable parts. The platform includes a lower receiver having a trigger assembly and magazine well connected to an upper receiver that contains the barrel along with the bolt carrier and its associated components (collectively referred to as the "bolt carrier group").

In the traditional AR-15 platform, a takedown pin and a pivot pin connect the upper receiver lower receiver in a manner that is well known in the art. The takedown pin is housed in a takedown receptacle disposed in the lower receiver above a pistol grip, and the pivot pin is housed a pivot receptacle disposed in a yoked end at the front of the lower receiver. For reference, the front of the lower receiver is the end located closest to the barrel when the upper and lower receivers are connected.

When the upper and lower receivers are connected, both the takedown pin and the pivot pin extend from a first side of the lower receiver to a second side of the lower receiver. The takedown receptacle comprises a first takedown pin passage located on the first side of the lower receiver and a second takedown pin passage located on a second side of the lower receiver. The first and second takedown pin passages are axially aligned. To lock the upper receiver and the lower receiver together, the takedown pin is inserted into a takedown lug that extends from the upper receiver to a position between the first and second takedown pin passages. Similarly, the pivot receptacle comprises a first pivot pin passage located in a first leg of the yoked end and a second pivot pin passage located in a second leg of the yoked end, with the two pivot pin passages being axially aligned. To further secure the upper receiver on the lower receiver, the pivot pin is inserted through a pivot lug that extends from the upper receiver to a position between the first and second pivot pin passages.

To disconnect the upper and lower receivers the takedown pin and the pivot pin are axially displaced toward the first side of the lower receiver. In this regard, the takedown pin is displaced out of the second takedown pin passage and out of the takedown lug. Similarly, the pivot pin is displaced out of the second pivot pin passage and out of the pivot lug. With the two pins removed, the upper and lower receivers can be separated.

Despite structural differences between the AR-15 and the M16 due to their different shooting actions, the M16 platform is structurally identical to the AR-15 platform with respect to the connection of the upper and lower receivers. Specifically, the M16 platform also employs an upper and lower receiver connected with a takedown pin and a pivot pin.

The purpose behind the dual pin design of the AR-15/M16 platform was to allow rapid servicing of the firearm in the field. In this regard, the pins are supposed to be designed so that a user can quickly remove them to service the firearm in the field. For example, once the takedown pin is removed from the takedown lug, the upper receiver can be rotated at the pivot lug about the pivot pin so that the bolt carrier group is exposed, and operational issues encountered by the bolt carrier group can be addressed in the field.

However, the dual pin design has not proven to be as effective as intended and has led to certain disadvantages. In this regard, detents that hold the pins in place in their respective receptacles can be too tight or there may not be enough clearance between the pins and their respective receptacles, thereby requiring too much force to effectively remove the pins in the field. In contrast, if the detents are loosened or the clearance between the pins and their receptacles is increased, the upper and lower receivers may not be securely connected or excessive slop may be present between the two receivers, thereby causing user insecurity about the soundness of the firearm. Thus, the user is left with a Hobson's choice of having a tight firearm that is not easy to service in the field or a slop-ridden firearm that is easily field serviceable but causes insecurity about safety.

Many users opt for the latter choice and attempt to develop makeshift solutions to address the excessive slop problem. For example, rubber wedges have been developed to insert between the upper and lower receivers to help tighten the slop, but the wedges can get lost when servicing the firearm in the field and are an additional component part the user must account for when trying to reassemble the firearm. Additionally, the wedges may not seat properly between the upper and lower receivers, so the user must fumble with the wedge to ensure it is properly seated and then hold the wedge in place while, at the same time, trying to rotate the upper receiver back to its connecting position. Finally, the wedges may need to be trimmed or modified to fit. Other makeshift solutions include placing o-rings around the takedown lug, using special fit pins with tighter tolerances (which makes them too tight remove in the field), or placing shims on the pivot pin to reduce side-to-side slop at the pivot lug.

None of the above solutions ideally addresses the problem of excessive slop while preserving the original rapid field servicing intent behind the AR-15/M16 design. Accordingly, it is an object of the present invention to offer an AR-15/M16 platform that reduces excessive slop yet maintains the original intent behind the AR-15/M16 design.

Additionally, it is a further object of the present invention to offer an AR-15/M16 platform that allows for easier servicing of the firearm. In this regard, the present invention eliminates axially displaceable pins and, therefore, removes obstacles users encounter when trying remove pins that are too tightly fit in their respective receptacle.

It is yet another object of the present invention to replace the traditional dual-pin AR-15/M16 platform with a tighter, more secure platform that still provides a modular design. In this regard, the presently disclosed platform allows for a standard interface between upper and lower receivers such that users can readily source interchangeable parts.

BRIEF SUMMARY

The present invention includes an apparatus and method that allows for a more efficient and reliable connection of an upper and lower receiver in a firearm platform. In particular, the present invention includes a locking member that is displaceable into a perimeter opening of a takedown lug and does not employ axial displacement transverse to the upper and lower receiver. Additionally, embodiments of the present invention may include a locking member that exerts continual force against the takedown lug to force the upper receiver against the lower receiver, thereby creating a more secure, tighter connection between the receivers.

The present disclosure also relates to an improved detent assembly to hold the locking member in a locked position. In this regard, embodiments of the present invention may include a detent plunger within a passage in the lower receiver and detent protrusion extending outward of a sidewall of the lower receiver. The detent protrusion obstructs displacement of a takedown lever on the a sidewall of the lower receiver, which is part of a locking assembly that includes the locking member. Accordingly, when the takedown lever is displaced on the sidewall to put the locking member in the locked position, the detent protrusion holds the takedown lever in place so that the locking member cannot be displaced on the sidewall and remains in the locked position.

DETAILED DESCRIPTION

Figure 1:
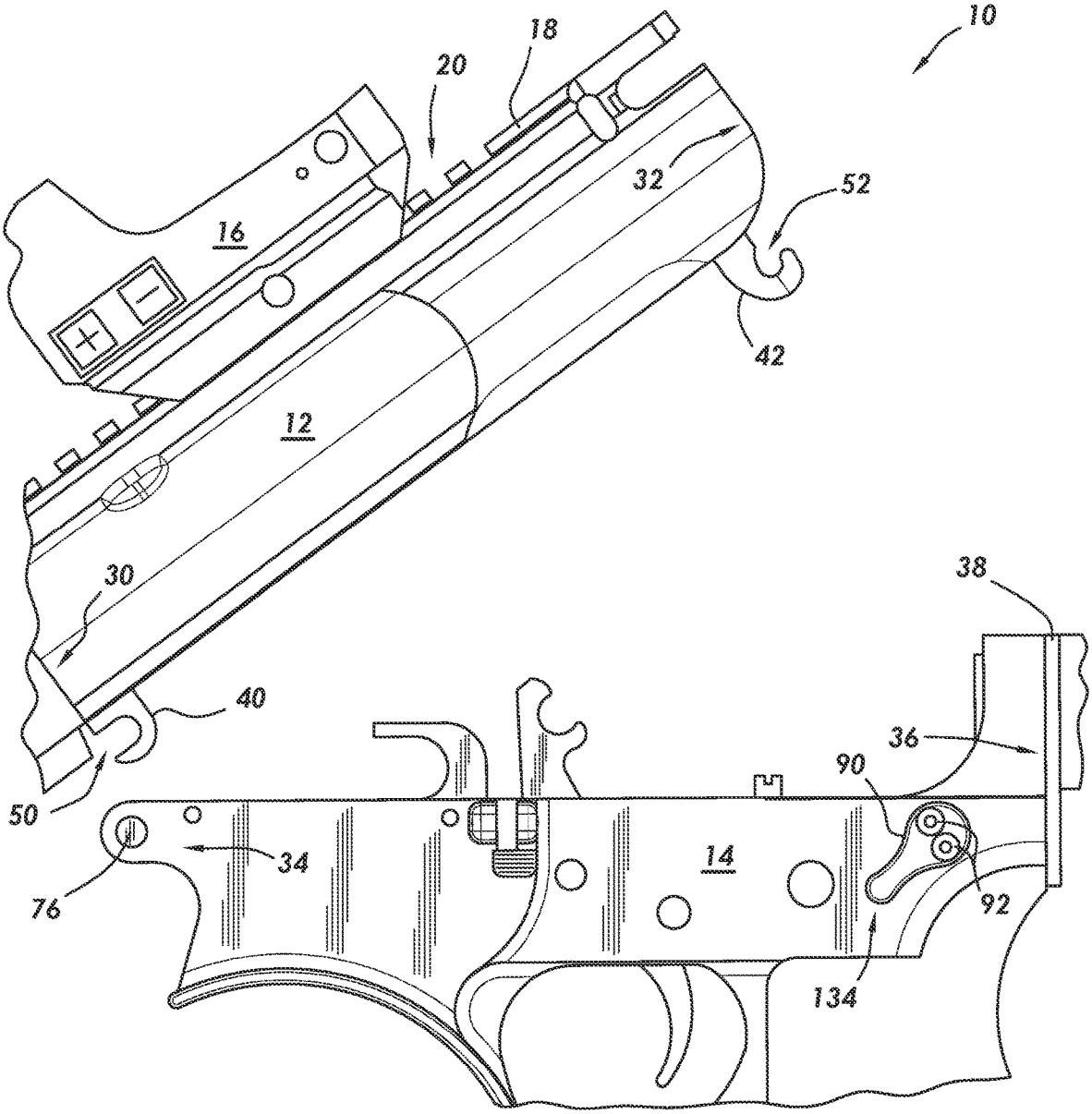
FIG. 1 is an exploded view of an embodiment of the present invention, with an upper receiver separated from a lower receiver.

FIG. 1 shows an embodiment 10 of the present invention. The embodiment 10 comprises an upper receiver 12 and a lower receiver 14. As shown, the upper receiver 12 is disconnected and separated from the lower receiver 14. The embodiment 10 also has a sight 16 mounted to a picatinny rail 18 extending along a top portion 20 of the upper receiver 12.

The upper receiver 12 has a barrel end 30 that connects to a firearm barrel (not shown) and a buttstock end 32 opposite the barrel end 30. The lower receiver 14 has a yoked end 34 at a front side thereof and a buttstock end 36 opposite the yoked end 34. The buttstock end 36 terminates in an end plate 38 that is similar to an end plate in the traditional AR-15-/M16 platform but may optionally have additional holes (not shown) for access to one or more spring detent tightening screws, as further discussed below.

A pivot lug 40 extends downwardly from the upper receiver 12 near the barrel end 30, while a takedown lug 42 extends downwardly from the upper receiver 12 near the buttstock end 32. Unlike the traditional AR-15/M16 platform where a complete cylindrical perimeter defines a passage within the takedown lug for the takedown pin and a complete cylindrical perimeter defines a passage within the pivot lug for the pivot pin, the pivot lug 40 and the takedown lug 42 in the embodiment 10 have passages defined by less than a complete cylindrical perimeter, thereby creating perimeter openings which are not present on the standard AR-15/M16 platform.

Figure 2:
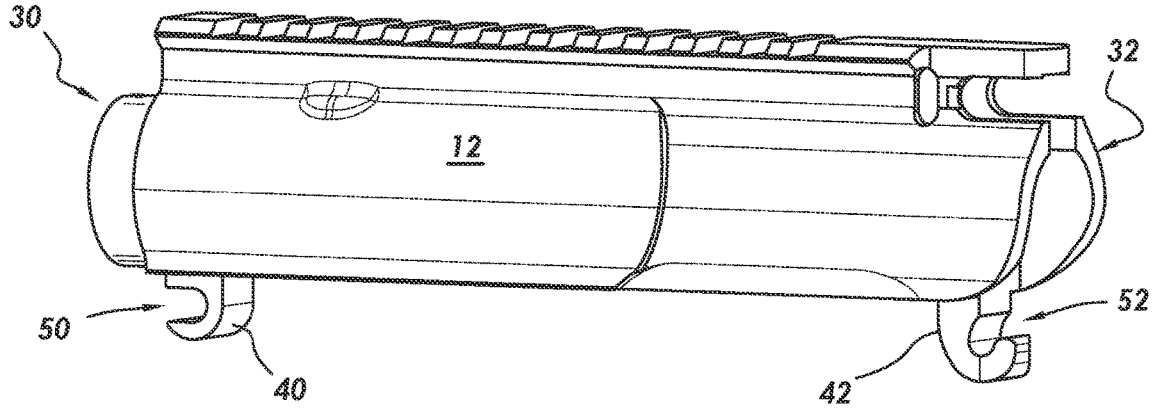
FIG. 2 is a left side perspective view of the upper receiver in FIG. 1.
Figure 3:
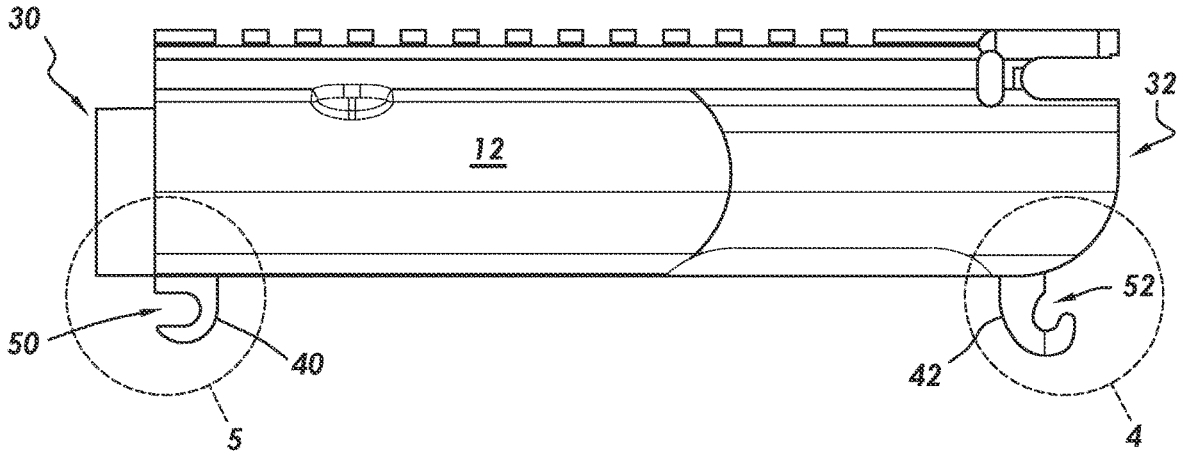
FIG. 3 is a left side elevation view of the upper receiver in FIG. 1.

As shown in FIGS. 2 and 3, the pivot lug 40 and the takedown lug 42 both have shape profiles with openings on their perimeter in generally opposite directions. The pivot lug 40 has a perimeter opening 50 that faces forward in the general direction of the barrel end 30 while the takedown lug 42 has a perimeter opening 52 that faces rearward in the general direction of the buttstock end 32.

Figure 4:
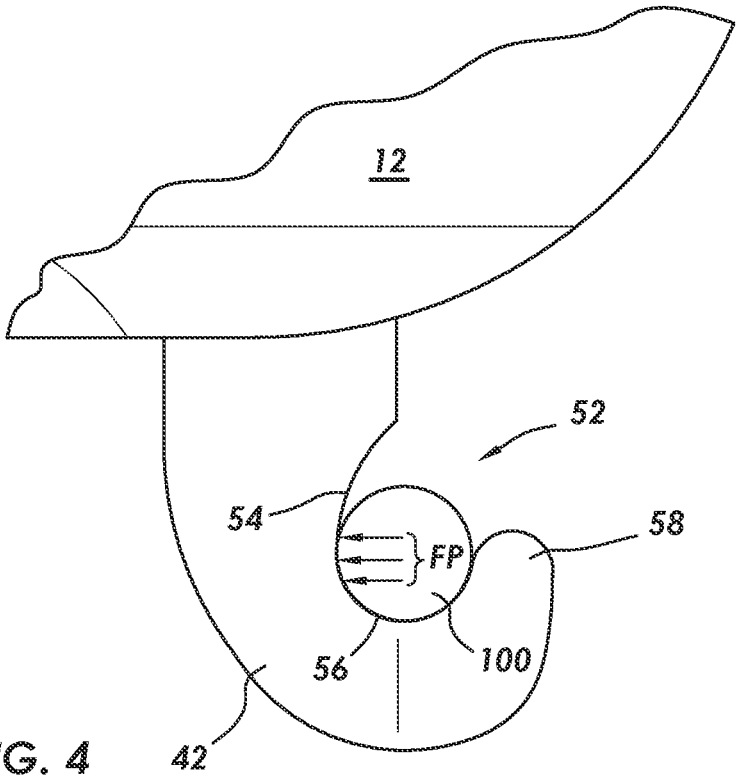
FIG. 4 is a close-up, cutaway view of a takedown lug in FIG. 3 with a locking member added.

Preferably, the shape profiles and perimeter openings of the takedown lug 42 and the pivot lug 40 are not identical due to their differing functions. As best shown in FIG. 4, the perimeter opening 52 of the takedown lug 42 preferably extends along an upward tilt that is at least partially defined by a bearing surface 54 extending into a semicylindrical bottom 56. As will be seen, forward pressure shown by pressure lines FP is applied against the bearing surface 54 by a locking member 100 that exerts force in a direction generally toward the barrel end (not shown) of the upper receiver 12. Preferably, the bearing surface 54 is contoured such that the locking member 100 exerts forward pressure as the member 100 is inserted into the opening 52 and displaced downward into to semicylindrical bottom 56. As shown in FIG. 4, the locking member 100 continues to exert forward pressure when seated in the semicylindrical bottom 56, which helps tighten the connection between the upper receiver 12 and the lower receiver (not shown). Additionally, a lip 58 helps further define the upward tilt of the perimeter opening 52, and the lip 58 helps hold the locking member 100 securely in place when seated within the semicylindrical bottom 56.

Figure 5:
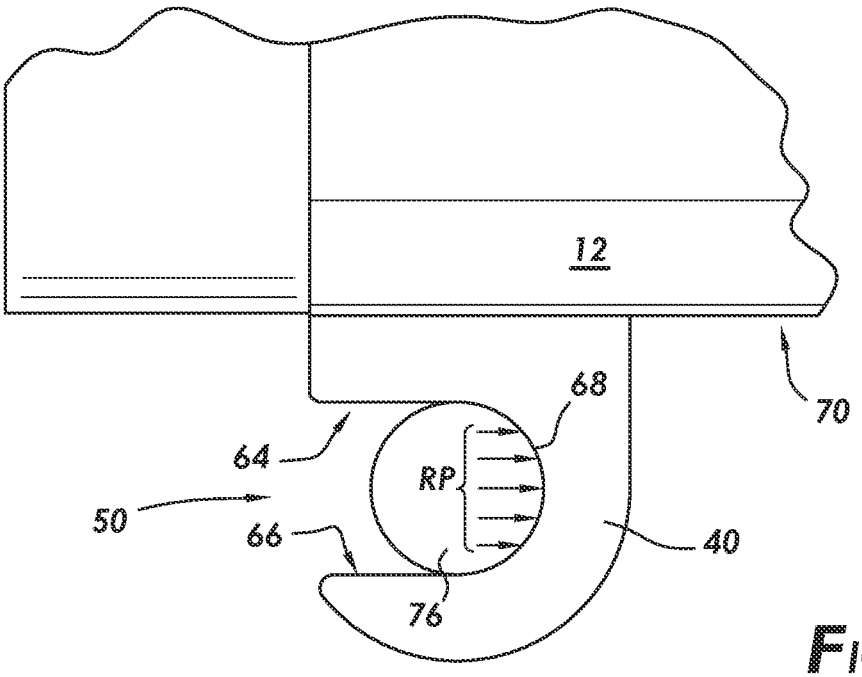
FIG. 5 is a close-up, cutaway view of a pivot lug in FIG. 3 with a pivot pin added.

The perimeter opening 50 of the pivot lug 40 is preferably more symmetric than the perimeter opening 52 of the takedown lug 42. As best shown in FIG. 5, the opening 50 is preferably defined by a first planar surface 64 and a second planar surface 66 parallel to the first planar surface 64. The planar surfaces 64, 66 both extend into a semicylindrical bottom 68 such that the first planar surface 64 intersects the upper end of the semicylindrical bottom 68 and second planar surface 66 intersects the lower end of the semicylindrical bottom 68.

Additionally, the perimeter opening 50 is preferably oriented such that the first and second planar surfaces 64, 66 are parallel to the direction the upper receiver 12 travels when pushed forward by the force of the locking member 100 against the bearing surface 54 of the takedown lug 42, as discussed in FIG. 4. Accordingly, a pivot pin 76 that occupies the pivot lug 40 will bear symmetrically against the semicylindrical bottom 68 as shown by rearward pressure lines RP when the upper receiver 12 is pushed forward by the locking member 100. In the embodiment 10, the first and second planar surfaces 64, 66 are oriented parallel to the surface 70 of the upper receiver 12 from which the pivot lug 40 extends.

Figure 6:
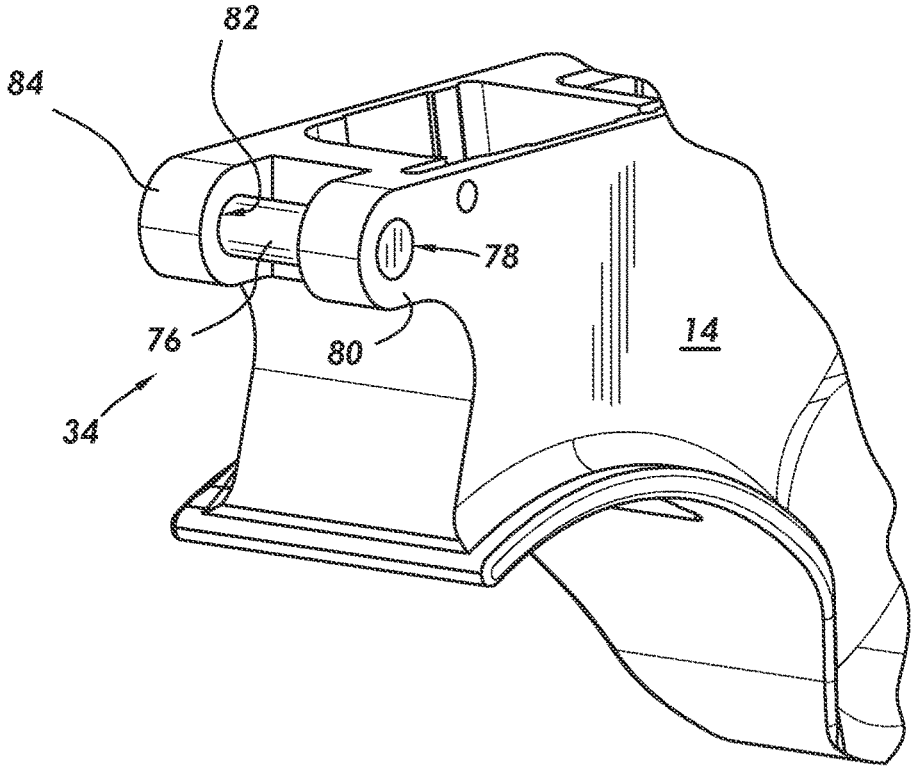
FIG. 6 is a close-up front perspective view of a yoked end of the lower receiver in FIG. 1.

As shown in FIG. 6, the yoked end 34 of the lower receiver 14 has the pivot pin 76 extending between a first pivot pin passage 78 in a first leg 80 of the yoked end 34 and a second pivot pin passage 82 in a second leg 84 of the yoked end 34. Unlike the traditional AR-15/M16 platform, the pivot pin 76 in the embodiment 10 is static within the yoked end 34 because the pin 76 does not axially displace within the first and second pivot pin passages 78, 82. Instead, the pivot pin 76 is preferably installed with an interference fit at the first and second pivot pin passages 78, 82. Alternatively, the pivot pin 76 may be machined or forged as an integral part between the first and second legs 80, 84 of the yoked end 34.

Referring back to FIG. 1, a first takedown lever 90 is positioned near the buttstock end 36 of the lower receiver 14 in an area where the takedown pin (not shown) is normally located on a traditional AR-15/M16 platform. The takedown lever 90 is part of a locking assembly (not shown) within the lower receiver 14 and the lever 90 is secured to the assembly with one or more screws 92.

Figure 7:
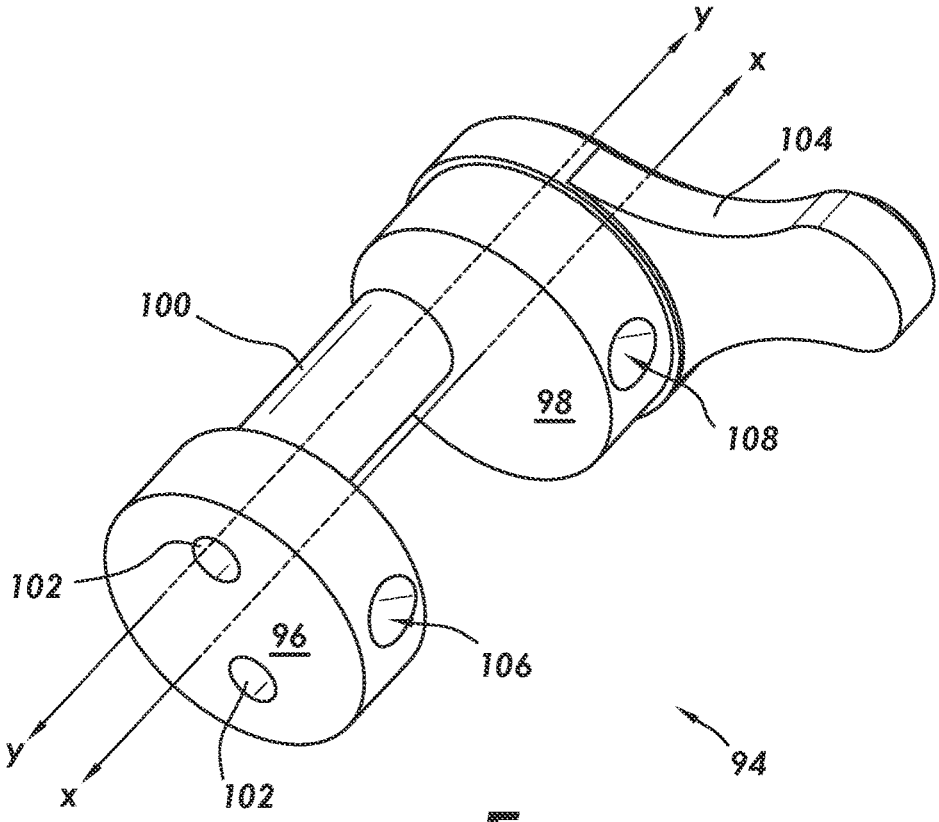
FIG. 7 is a rear perspective view of an embodiment of a locking assembly.

A locking assembly 94 is shown in FIG. 7. The locking assembly 94 comprises a first receiver sidewall member 96 and a second receiver sidewall member 98. As will be seen, the receiver sidewall members 96, 98 each occupy a passage within a sidewall of the lower receiver. The first and second sidewall receiver members 96, 98 are preferably shaped congruent to each other and, as shown, the sidewall members 96, 98 are preferably congruent cylinders that are axially aligned along a center axis x.

The locking member 100 extends between the first and second receiver sidewall members 96, 98. The locking member 100 may be any structure that fits at least partially within the perimeter opening 52 of the takedown lug 42 when the locking assembly is displaced in a direction generally toward the front of the lower receiver to a locked position. As shown, the locking member 100 is preferably a cylinder having a radius smaller than the preferred cylindrical receiver sidewall members 96, 98.

The illustrated locking member extends along a center axis y that is not coincident with axis x. Accordingly, when the first and second receiver sidewall members 96, 98 are displaced, center axis y does not displace along the same path as center axis x. For example, when the first and second receiver sidewall members 96, 98 are cylinders and are rotated about axis x, locking member 100 rotationally displaces about axis x in a path radially distanced from axis x.

Also shown in FIG. 7 are one or more internally threaded receptacles 102 that accept the screws (not shown) which secure the first takedown lever (not shown) on the first receiver sidewall member 96. A second takedown lever 104 is connected to the second receiver sidewall member 98 and is preferably shaped congruent to the first takedown lever (not shown). The second takedown lever 104 may be integrally formed with the second receiver sidewall member 98 through machining, forging, injection molding, or the like.

Figure 8:
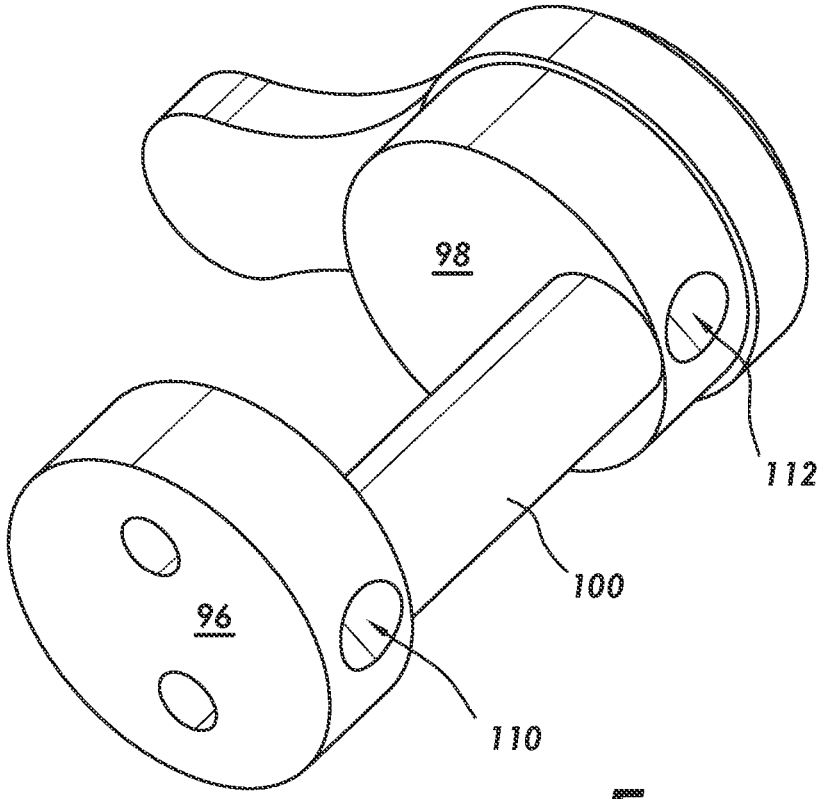
FIG. 8 is a front perspective view of the embodiment shown in FIG. 7.

FIG. 7 also shows a first detent receptacle 106 that is present on a perimeter surface of the first receiver sidewall member 96 and a first detent receptacle 108 that is present on a perimeter surface of the second receiver sidewall member 98. For example, when the first and second receiver sidewall members 96, 98 are cylindrical, the first detent receptacles 106, 108 are on the circumferential perimeter of the cylinder. FIG. 8 shows a second detent receptacle 110 that is present on a perimeter surface of the first receiver sidewall member 96 and a second detent receptacle 112 that is present on a perimeter surface of the second receiver sidewall member 98. With the preferred cylindrical receiver sidewall members 96, 98, the first detent is located approximately 130 degrees from the second detent. These detent receptacles accept detents to help hold the locking assembly in place in the locked and unlocked positions, as further discussed below.

FIG. 8 also shows that the circumferential perimeter wall of the preferred cylindrical locking member 100 tangentially aligns with the circumferential perimeter walls of the preferred cylindrical first and second receiver sidewall members 96, 98.

Figure 9:
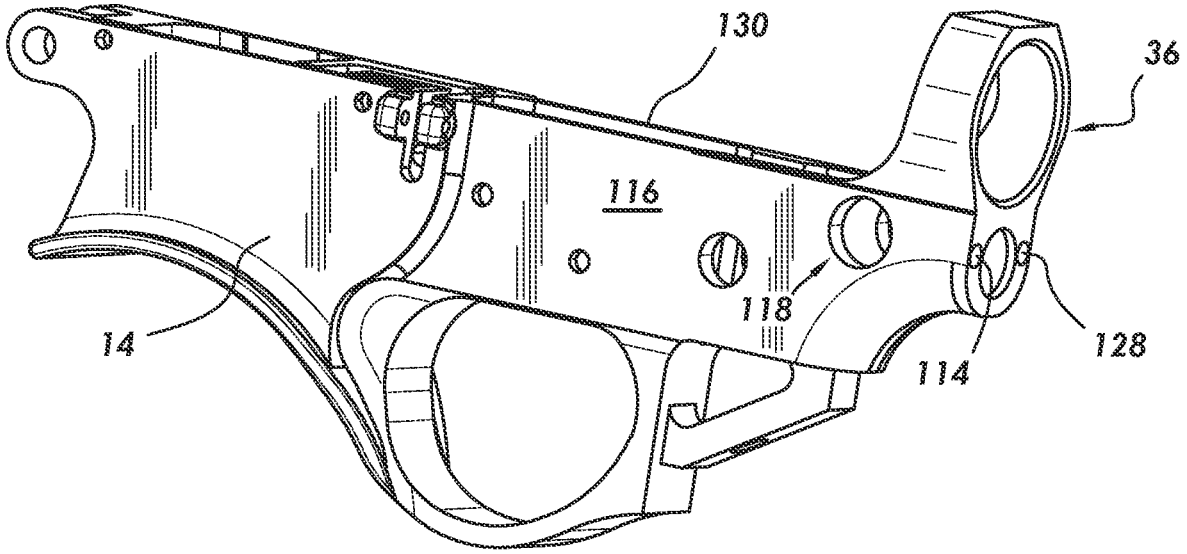
FIG. 9 is a rear perspective view of the lower receiver in FIG. 1 with the locking assembly removed.

FIG. 9 shows the buttstock end 36 of the lower receiver 14 with the end plate (not shown) removed. A first detent passage 114 extends into a first sidewall 116 of the lower receiver 14 toward a first takedown passage 118 disposed through the sidewall 116. The first takedown passage 118 is shaped to snuggly receive the first receiver sidewall member 96 (not shown) and allow displacement of the member 96 therein. In the embodiment 10, the first takedown passage 118 is a cylinder that snuggly receives the preferred cylindrical first receiver sidewall member 96 shown in FIGS. 7-8, and the cylindrical first receiver sidewall member 96 can rotate within the takedown passage 118. However, depending on the design of the embodiment and the shape of the first receiver sidewall member 96, the first takedown passage 118 may be differently shaped to accommodate alternative movement (e.g., translational movement in a direction parallel to the sidewall) of the first receiver sidewall member 96.

FIG. 9 also shows a second detent passage 128 extending into a second sidewall 130 of the lower receiver 14 that is opposite of the first sidewall 116. The first and second detent passages 114, 128 preferably each house a detent (not shown) that is forced by a spring into the detent receptacles on the receiver sidewall members, which helps hold the locking assembly in the locked and unlocked positions. In some embodiments, the force of the spring on the detent may be adjustable by rotating a screw. When such adjustability features are present, the end plate (not shown) may have holes aligned with the first and second detent passages 114, 128 for access to the spring detent adjusting screw.

Figure 10:
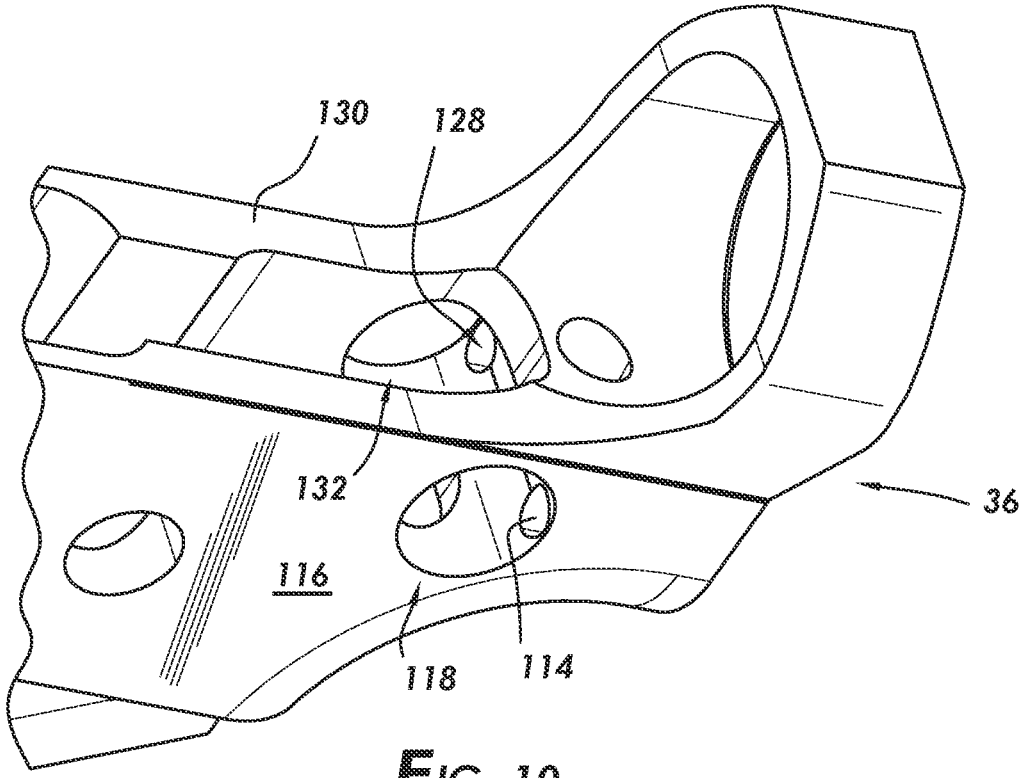
FIG. 10 is a close-up front perspective view of a buttstock end of the lower receiver in FIG. 9.

FIG. 10 shows the first detent passage 114 extending into the first takedown passage 118 and the second detent passage 128 extending into a second takedown passage 132. Accordingly, a detent (not shown) has access to the detent receptacles on the receiver sidewall members that will be located within their respective takedown passages 118, 132.

Similar to the first takedown passage 118, the second takedown passage 132 is shaped to snuggly receive the second receiver sidewall member and allow displacement of the sidewall member therein. In the embodiment 10, the second takedown passage 132 is a cylinder that snuggly receives the preferred cylindrical second receiver sidewall member 98 shown in FIGS. 7-8, and the cylindrical second receiver sidewall member 98 can rotate within the second takedown passage 132. However, depending on the design of the embodiment and the shape of the second receiver sidewall member 98, the second takedown passage 132 may be differently shaped to accommodate alternative movement (e.g., translational movement in a direction parallel to the sidewall) of the second receiver sidewall member 98.

Referring back to FIG. 1, to connect the upper receiver 12 and the lower receiver 14, the perimeter opening 50 of the pivot lug 40 is inserted over the pivot pin 76 and the upper receiver 12 is forced forward so that the pivot pin 76 bears against the pivot lug 40. With forward pressure maintained, the upper receiver 12 is rotated downward so that the takedown lug 42 enters the interior of the lower receiver 14. Then, the takedown lever 90 is displaced on the lower receiver 14 to a locked position, thereby causing the locking member within the locking assembly to at least partially enter the perimeter opening 52 of the takedown lug 42. Preferably, in the locked position the locking member 100 maintains forward pressure against a surface on the takedown lug to tightly lock the upper receiver 12 on the lower receiver 14.

Figure 11:
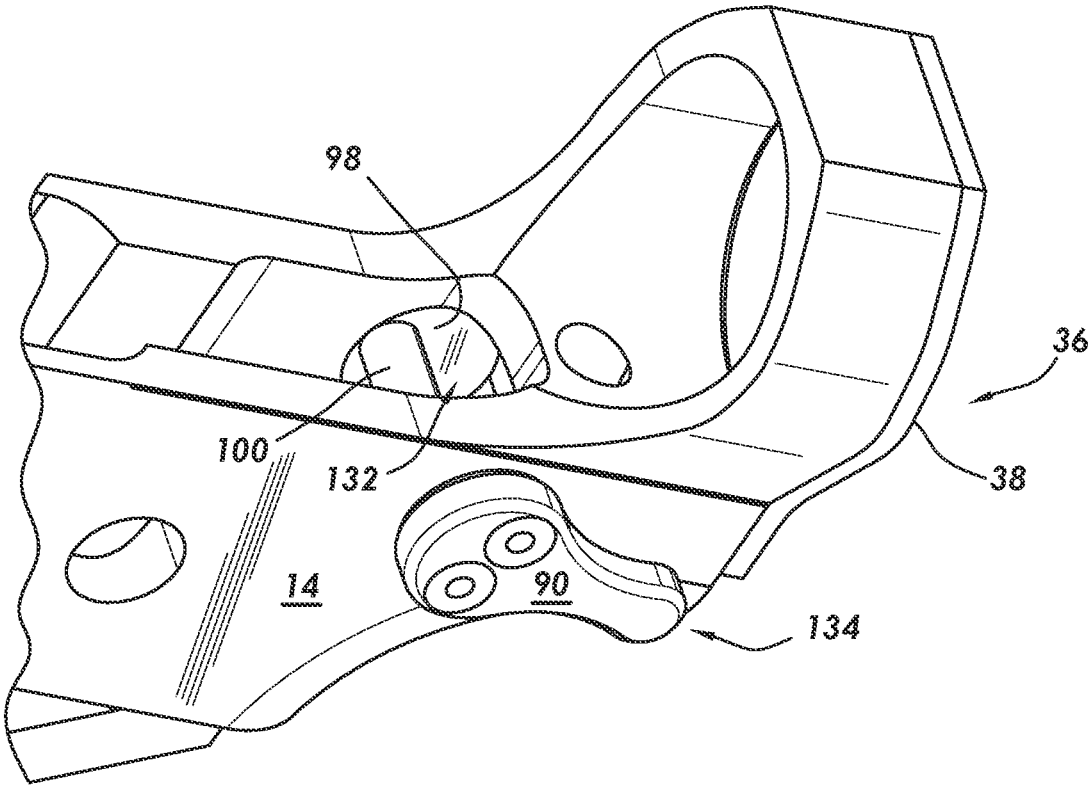
FIG. 11 is a close-up top perspective view of the left side of the lower receiver in FIG. 1, with a first takedown lever and a corresponding locking member in a locked position.

In FIG. 1, for example, the takedown lever 90 is in an unlocked position, with its narrow end 134 generally directed toward the yoked end 34 of the lower receiver 14. In contrast, FIG. 11 shows the takedown lever 90 rotated to the locked position with its narrow end 134 generally directed toward the buttstock end 36 and the end plate 38. Preferably, the takedown lever rotates approximately 130 degrees to go from the unlocked position to the locked position, and vice versa, however, differing degrees of rotation may be present depending on the design of the embodiment.

Figure 12:
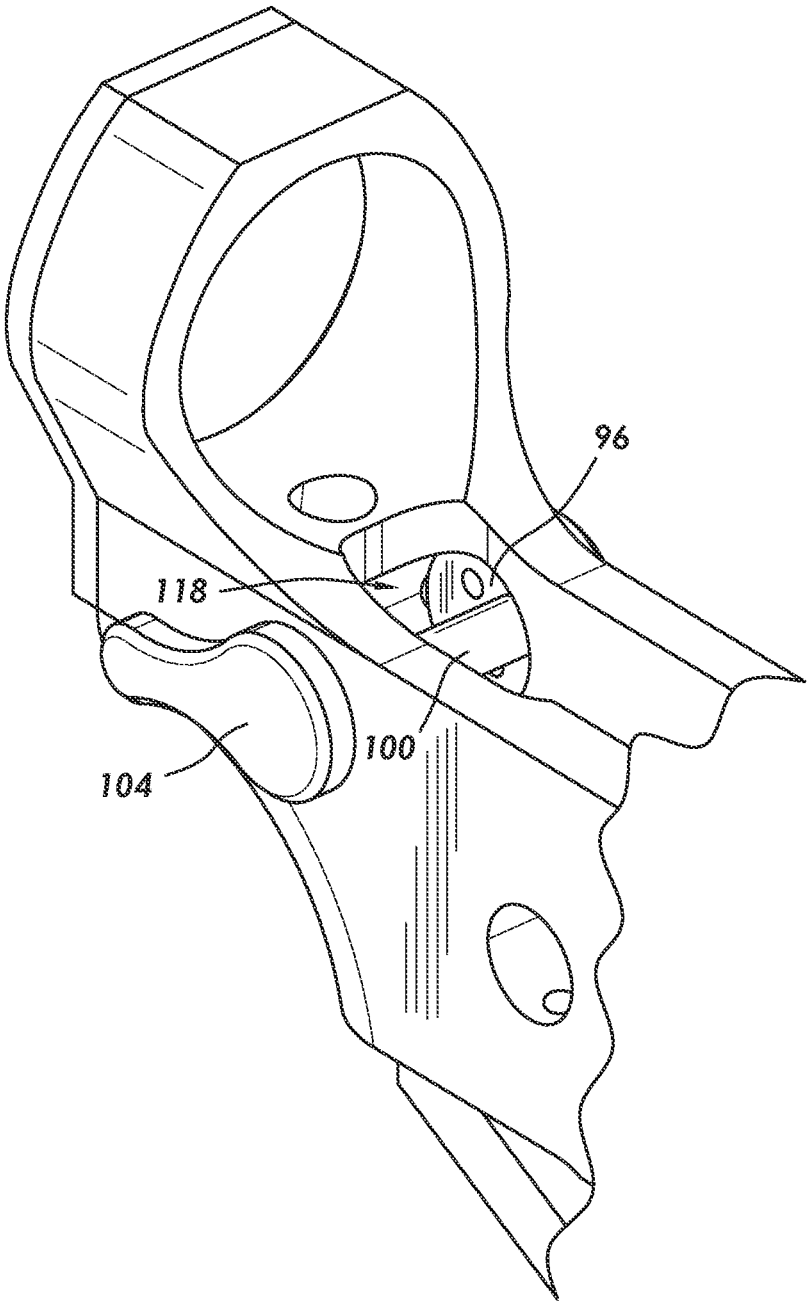
FIG. 12 is a close-up top perspective view of the right side of the lower receiver in FIG. 1, with a second takedown lever and the locking member in the locked position.

FIG. 11 also shows the locking member 100 extending transversely across the interior of the lower receiver 14. The locking member 100 extends to the second receiver sidewall member 98 within the second takedown passage 132. In the locked position, the locking member 100 is oriented toward the front side of the second takedown passage 132, with the front being the location of the passage closest to the yoked end (not shown—see FIG. 1) of the lower receiver 14. FIG. 12 shows an opposite end of the locking member 100 extending to the first receiver sidewall member 96 within the first takedown passage 118. Once again, in the locked position, the locking member 100 is oriented toward the front side of the first takedown passage 118.

With the locking assembly in the locked position, the locking member 100 cams against the bearing surface 54 of the takedown lug 42. The camming action pushes the upper receiver forward so the semicylindrical bottom 68 of the pivot lug 40 bears against the pivot pin 76, thereby creating a tight fit between the upper and lower receivers.

Figure 13:
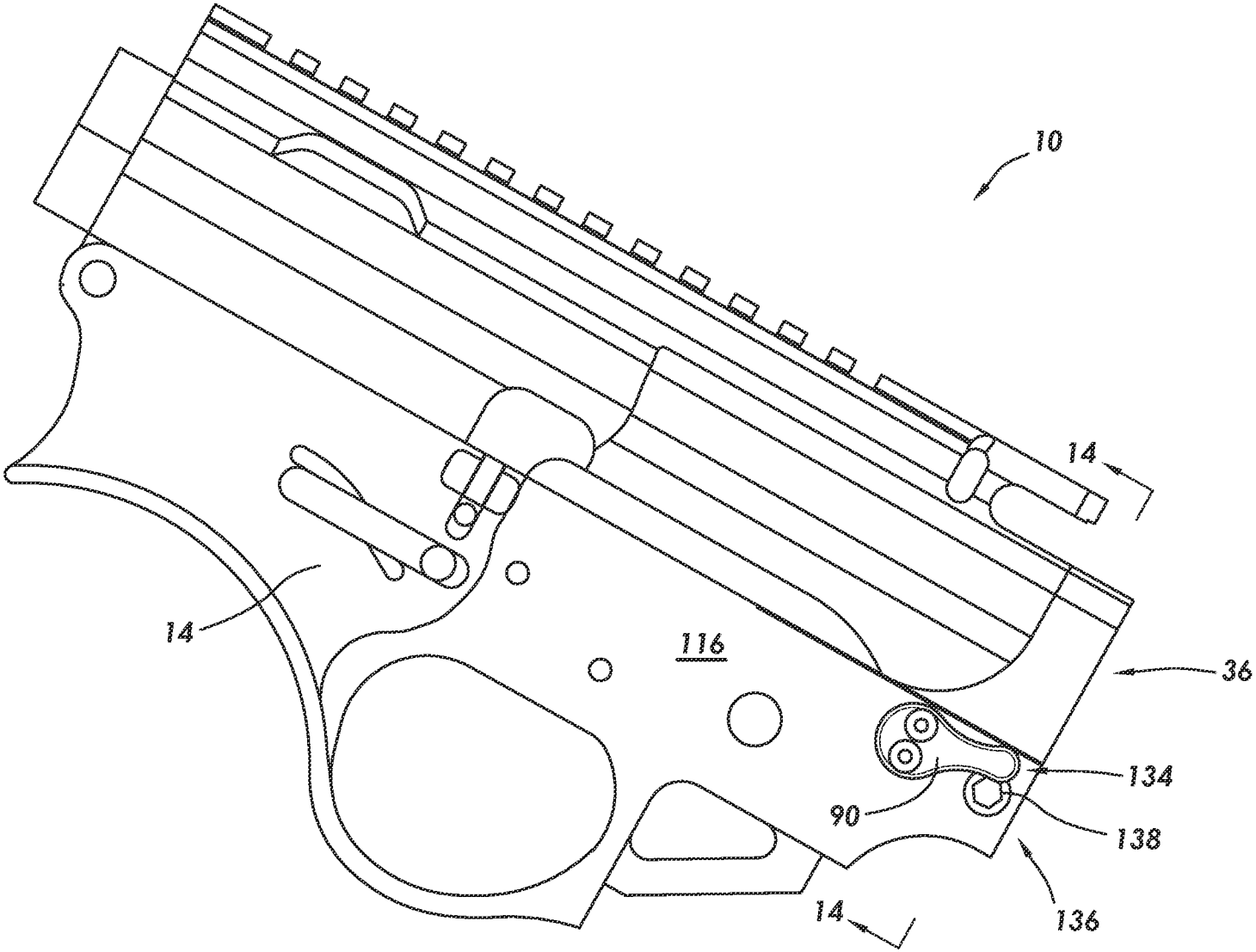
FIG. 13 is a left side elevation view of an embodiment of the present invention, with the upper receiver connected to the lower receiver and an improved detent assembly on the lower receiver to hold the locking assembly in the locked position.

FIG. 13 illustrates an embodiment 10 with an improved detent assembly 136 located on the lower receiver 14 near the buttstock end 36. As shown, the first takedown lever 90 is in a locked position with its narrow end 134 generally directed toward the buttstock end 36. A set screw 138 is illustrated below the narrow end 134. The set screw 138 extends into a detent passage that extends from the first sidewall 116 of the lower receiver 14 to the second sidewall 130 (not shown) of the lower receiver 14.

Figure 14:
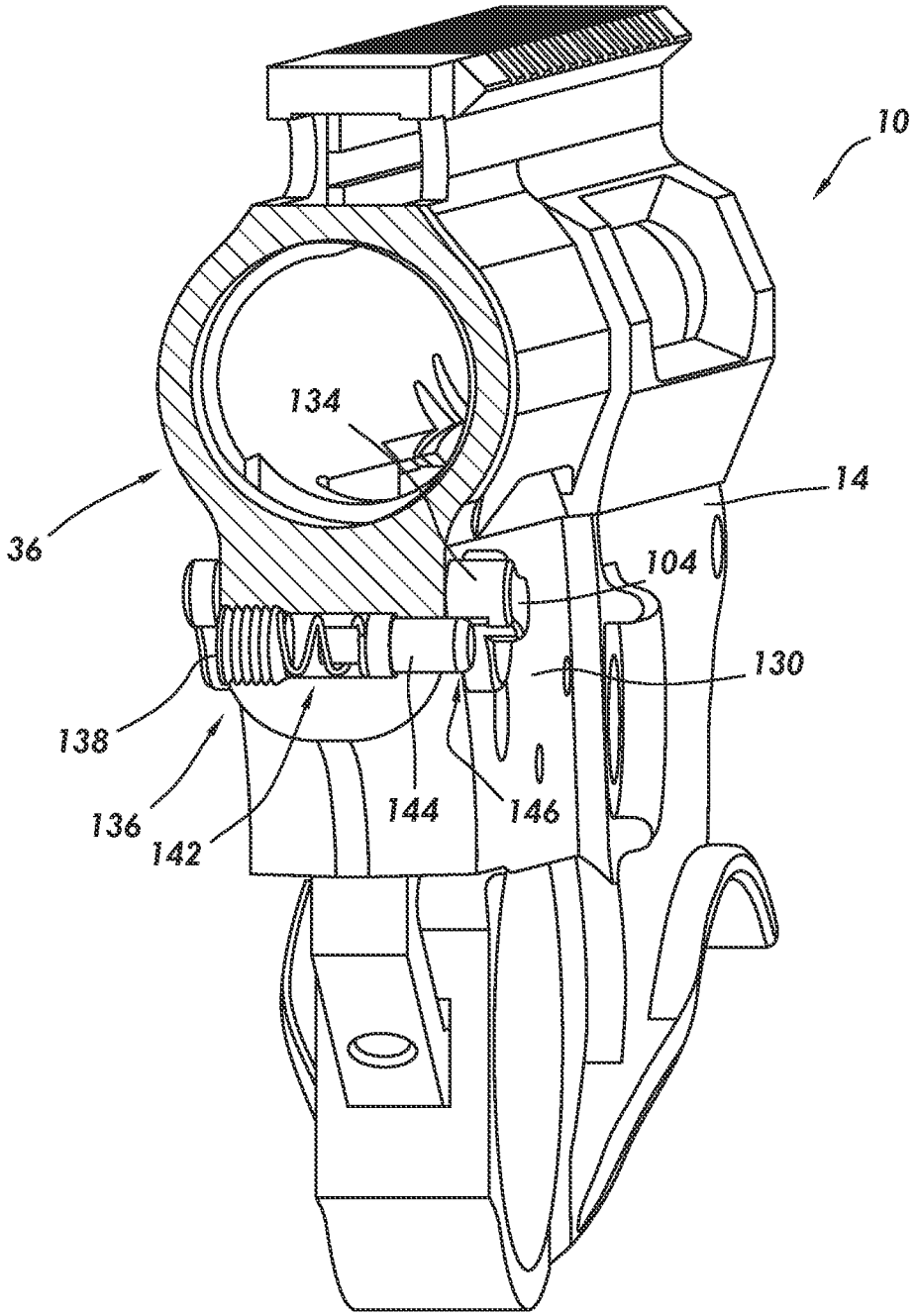
FIG. 14 is as a rear perspective view of the embodiment in FIG. 13 showing the lower receiver in a cross section taken along section line 14-14 in FIG. 13 and the improved detent assembly (not in cross section) within a passage in the lower receiver.

FIG. 14 shows the embodiment 10 with the buttstock end 36 of the lower receiver 14 in cross section and the improved detent assembly 136, which is not in cross section, within the detent passage 140. The detent assembly 136 includes the set screw 138, a spring means 142, and a detent plunger 144 with a detent protrusion 146 extending outward of the second sidewall 130 of the lower receiver 14. The detent protrusion 146 is positioned below the narrow end 134 of the second takedown lever 104, thereby preventing rotational displacement of the takedown lever 104 on the second sidewall 130 in the counterclockwise direction. Accordingly, the detent protrusion 146 prevents the takedown lever 104 from displacing on the second sidewall 130 out of the locked position.

With the improved detent assembly 136, the previously discussed first and second detent passages 114, 128 (see FIG. 9), as well as the components housed therein, are no longer necessary. Additionally, the various detent receptacles 106, 108, 110, 112 (see FIGS. 7 and 8) on the first and second receiver sidewall members 96, 98 of the locking assembly 94 are no longer necessary.

Figure 15:
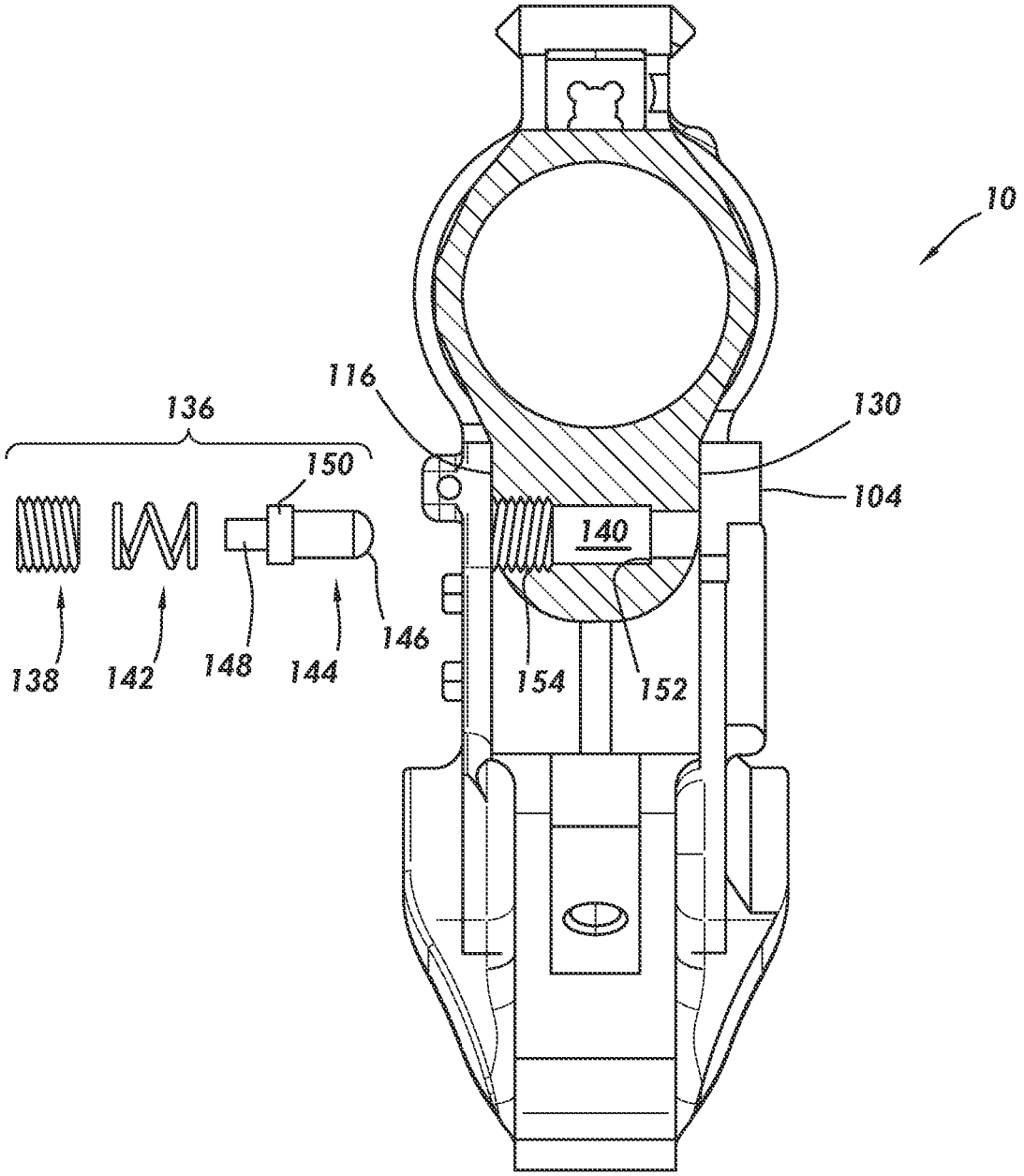
FIG. 15 is a rear elevation view of the embodiment in FIG. 14 showing the improved detent assembly exploded from the passage in the lower receiver.

FIG. 15 shows the preferred detent assembly 136 in an exploded view. As shown the spring means 142 is positioned between the set screw 138 and the detent plunger 144. Accordingly, when installed in the detent passage 140, the spring means 142 is compressed against the set screw 138 and the plunger 144, as shown in FIG. 14. The set screw 138 is threaded into a threaded section 154 of the detent passage 140 and is not displaceable within the passage unless unscrewed. In contrast, the plunger 144 may be axially displaced into the passage 140 by exerting force against the detent protrusion 146 directed toward the passage 140.

Referring back to FIG. 15, the preferred detent plunger 144 has a stabilizing portion 148 that occupies an interior of the spring means 142 for added stability, and a flange 150 between the portion 148 and the detent protrusion 146.

When present, the flange 150 is sized to abut a shoulder 152 within the detent passage 140, thereby preventing the spring means 142 from ejecting the detent plunger 144 wholly out of the passage 140.

It should be noted that the detent assembly 136 may be in a variety of forms provided that it has a spring means that biases the detent protrusion 146 to its position outward of the sidewall 130 and supplies enough force to maintain the detent protrusion 146 in its position outward of the sidewall 130 against any force applied by the takedown lever 104 trying to displace out of the locked position. It has been found that a helical compression spring which exerts seven (7) pounds of force is a suitable spring means for this purpose. However, other suitable spring means may include a spring steel or elastomeric insert, a disc spring, a conical spring, or a barrel spring.

Additionally, it should be noted that the preferred detent passage 140 illustrated in FIG. 15 extends through the lower receiver 14 (i.e., across the entirety of the lower receiver 14 from the first sidewall 116 to the second sidewall 130), and is orthogonal to the first and second sidewalls 116, 130. However, the improved detent assembly 136 contemplates a detent passage that may not extend across the entirety of the receiver and may not be orthogonal to one or more of the sidewalls 116, 130 in alternative embodiments.

The present invention is described in terms of one or more specifically-described embodiments which is/are presented for purposes of illustration and not of limitation. Those skilled in the art will recognize that alternative embodiments not specifically described herein can be used in carrying out the present invention. Other aspects and advantages of the present invention may be obtained from a study of this disclosure and the drawings, along with the appended claims.

We claim:

1. A firearm platform comprising:

an upper receiver having a takedown lug;

a lower receiver having an interior at least partially defined by a sidewall;

a locking assembly comprising (i) a locking member within the interior and (ii) a lever on the sidewall; and wherein displacement of the lever on the sidewall displaces the locking member between an unlocked position and a locked position, wherein the upper receiver and the lower receiver are fully separable from each other when in the unlocked position, wherein the upper receiver and the lower receiver are not fully separable from each other when in the locked position, and wherein the locking member is at least partially inside the takedown lug when in the locked position and outside of the takedown lug when in the unlocked position.

2. The firearm platform of claim 1 wherein the takedown lug comprises a perimeter opening and the locking member enters said perimeter opening.

3. The firearm platform of claim 1 wherein displacement of the lever on the sidewall is rotational displacement.

4. A firearm platform comprising:

an upper receiver having a takedown lug;

a lower receiver having an interior at least partially defined by a sidewall;

a locking assembly that locks the upper receiver to the lower receiver by engaging the takedown lug comprising (i) a locking member within the interior and (ii) a lever on the sidewall, wherein displacement of the lever on the sidewall displaces the locking member, from an unlocked position where the locking member is outside of the takedown lug, to a locked position where the locking member is at least partially inside the takedown lug; and a protrusion that extends outward of the sidewall and prevents displacement of the lever in a direction that would remove the locking member from the locked position.

5. The firearm platform of claim 1 further comprising a detent assembly with detent protrusion and a spring means to bias said detent protrusion to a position outward of the sidewall.

6. The firearm platform of claim 5 wherein the spring means is a helical spring.

7. The firearm platform of claim 5 further comprising a detent passage within the lower receiver and wherein the spring means is housed within said detent passage.

8. The firearm platform of claim 7 where in the detent passage extends orthogonal to the sidewall.

9. The firearm platform of claim 7 wherein the detent passage extends through the lower receiver and a set screw is threaded into an end of the detent passage opposite the detent protrusion.

10. The firearm platform of claim 9 wherein the spring means is a helical spring and the detent assembly further comprises a detent plunger with the detent protrusion at one end and a stabilizing protrusion at an opposite end, said stabilizing protrusion being positioned within the helical spring.

11. A firearm platform comprising:

an upper receiver having a takedown lug;

a lower receiver having a first sidewall and a second sidewall;

a locking assembly comprising (i) a locking member between the first sidewall and the second sidewall and (ii) a lever on the second sidewall; and wherein displacement of the lever on the second sidewall displaces the locking member between a locked position and an unlocked position, and wherein the locking member is between the first and second sidewalls and removed from the takedown lug when in the unlocked position.

12. The firearm platform of claim 11 wherein the takedown lug comprises a perimeter opening and the locking member enters said perimeter opening.

13. The firearm platform of claim 11 wherein displacement of the lever on the second sidewall is rotational displacement.

14. A firearm platform comprising:

an upper receiver having a takedown lug;

a lower receiver having a first sidewall and a second sidewall;

a locking assembly that locks the upper receiver to the lower receiver by engaging the takedown lug comprising (i) a locking member between the first sidewall and the second sidewall and (ii) a lever on the second sidewall, wherein displacement of the lever on the second sidewall displaces the locking member from an unlocked position, where the locking member is exterior the takedown lug, to a locked position; and a protrusion that extends outward of the second sidewall and prevents displacement of the lever in a direction that would remove the locking member from the locked position.

15. The firearm platform of claim 11 further comprising a detent assembly with detent protrusion and a spring means to bias said detent protrusion to a position outward of the second sidewall.

16. The firearm platform of claim 15 wherein the spring means is a helical spring.

17. The firearm platform of claim 15 further comprising a detent passage within the lower receiver and wherein the spring means is housed within said detent passage.

18. The firearm platform of claim 17 wherein the detent passage extends from the first sidewall to the second sidewall and a set screw is threaded into an end of the detent passage at the first sidewall.

19. The firearm platform of claim 18 where in the detent passage extends orthogonal to the first sidewall and the second sidewall.

20. The firearm platform of claim 17 wherein the spring means is a helical spring and the detent assembly further comprises a detent plunger with the detent protrusion at one end and a stabilizing protrusion at an opposite end, said stabilizing protrusion being positioned within the helical spring.

21. A firearm platform comprising:

an upper receiver having a takedown lug, the takedown lug having a perimeter opening;

a lower receiver having an interior at least partially defined by a sidewall;

a locking assembly comprising (i) a locking member in the interior and (ii) a lever on the sidewall; and wherein, when in an unlocked position, the locking member is outside of the takedown lug, and rotation of the lever on the sidewall rotates the locking member at least partially through the perimeter opening and at least partially into the takedown lug where the locking member is in a locked position, wherein the locking member is in the interior of the lower receiver and unconstrained by the takedown lug when in the unlocked position, and wherein separation of the lower receiver and the upper receiver is inhibited via engagement of the locking member with the takedown lug when in the locked position.

22. A firearm platform comprising:

an upper receiver;

a lower receiver having an interior at least partially defined by a sidewall;

a locking assembly that locks the upper receiver to the lower receiver by engaging the takedown lug comprising (i) a locking member in the interior and (ii) a lever on the sidewall, wherein rotation of the lever on the sidewall rotates the locking member from an unlocked position, where the locking member is outside of a lug, to a locked position where the locking member at least partially enters the lug; and a protrusion that extends outward of the sidewall and prevents rotation of the lever in a direction that would rotate the locking member out of the locked position.

23. A firearm platform comprising:

an upper receiver having a takedown lug;

a lower receiver having an interior at least partially defined by a sidewall;

a locking assembly comprising (i) a locking member in the interior and (ii) a lever on the sidewall; and wherein the lever is movable to thereby rotate the locking member from an unlocked position, where the locking member in the interior of the lower receiver is outside of the takedown lug such that the upper and lower receivers are separable from each other, to a locked position, where the locking member is engaged with the takedown lug to thereby inhibit separation between the lower receiver and the upper receiver.

* * * * *